US010422180B2

(12) United States Patent
Lombard

(10) Patent No.: US 10,422,180 B2
(45) Date of Patent: Sep. 24, 2019

(54) JALOUSIE WINDOW DEVICE

(71) Applicant: LOGIIC, Saint-Denis de la Réunion (FR)

(72) Inventor: Grégoire Lombard, Saint-Denis de la Réunion (FR)

(73) Assignee: LOGIIC (FR)

( * ) Notice: Subject to any disclaimer, the term of this patent is extended or adjusted under 35 U.S.C. 154(b) by 0 days.

(21) Appl. No.: 15/568,281

(22) PCT Filed: Apr. 18, 2016

(86) PCT No.: PCT/FR2016/050898
§ 371 (c)(1),
(2) Date: Oct. 20, 2017

(87) PCT Pub. No.: WO2016/170258
PCT Pub. Date: Oct. 27, 2016

(65) Prior Publication Data

US 2018/0112456 A1 Apr. 26, 2018

(30) Foreign Application Priority Data

Apr. 23, 2015 (FR) ..... 15 53649

(51) Int. Cl.

| | |
|---|---|
| ***E06B 7/08*** | (2006.01) |
| ***E06B 7/084*** | (2006.01) |
| ***E06B 9/264*** | (2006.01) |
| ***E06B 9/28*** | (2006.01) |
| ***E06B 9/06*** | (2006.01) |
| ***E06B 9/266*** | (2006.01) |

(52) U.S. Cl.
CPC ..... *E06B 7/084* (2013.01); *E06B 9/0638* (2013.01); *E06B 9/264* (2013.01); *E06B 9/266* (2013.01); *E06B 9/28* (2013.01)

(58) Field of Classification Search
CPC . E06B 7/084; E06B 9/266; E06B 9/28; E06B 9/264; E06B 9/0638
USPC ..... 49/403, 74.1, 77.1
See application file for complete search history.

(56) References Cited

U.S. PATENT DOCUMENTS

| | | | | |
|---|---|---|---|---|
| 345,689 A * | 7/1886 | Hayes | E06B 9/52 160/236 |
| 345,691 A * | 7/1886 | Hayes | E06B 9/264 160/236 |
| 345,692 A * | 7/1886 | Hayes | E06B 9/264 160/236 |
| 2,867,861 A * | 1/1959 | Pilson | E06B 7/084 49/64 |

(Continued)

FOREIGN PATENT DOCUMENTS

| | | |
|---|---|---|
| GB | 2252349 A | 8/1992 |
| JP | S52100735 A | 8/1977 |

(Continued)

*Primary Examiner* — Jerry E Redman
(74) *Attorney, Agent, or Firm* — St. Onge Steward Johnston & Reens, LLC

(57) ABSTRACT

A device for forming a jalousie includes at least first and second louvres pivoting about a common axis between a position in which the two louvres overlap and a position of angular separation of the louvres about the common axis. Preferably, the first louvre is at least partly translucent and the second louvre is opaque.

19 Claims, 4 Drawing Sheets

(56) References Cited

U.S. PATENT DOCUMENTS 2,991,697 A * 7/1961 Vetere ..... E06B 7/084 359/596
3,791,280 A * 2/1974 Williamson ..... F24F 13/15 160/236
4,220,137 A * 9/1980 Tesch ..... F24J 2/0433 126/574
4,855,716 A * 8/1989 Jordal ..... E06B 7/086 340/541
5,221,363 A * 6/1993 Gillard ..... E06B 9/264 136/248
5,537,779 A * 7/1996 Jackson ..... E06B 7/084 49/463
5,560,147 A * 10/1996 Ashida ..... E06B 7/086 49/403
5,572,831 A * 11/1996 Rafiqui ..... E06B 9/386 160/236
6,098,339 A * 8/2000 Rivera ..... E06B 7/086 49/73.1
6,378,248 B1 * 4/2002 Jordal ..... E06B 7/094 49/64
6,467,935 B1 * 10/2002 Schwab ..... E06B 9/24 359/275
8,490,345 B2 * 7/2013 Fields ..... E05B 65/462 49/371
8,820,010 B2 * 9/2014 Abrua ..... A61B 17/0401 359/591
9,885,453 B2 * 2/2018 Tsujimoto ..... F21V 3/06
2002/0037697 A1 * 3/2002 Tokashiki ..... E06B 7/094 454/221
2006/0179721 A1 * 8/2006 Tan ..... E06B 7/084 49/403
2009/0056226 A1 * 3/2009 Zhang ..... E06B 7/08 49/74.1
2009/0272037 A1 * 11/2009 Sosa ..... E06B 7/086 49/74.1

FOREIGN PATENT DOCUMENTS

JP 08013944 A * 1/1996
JP 2001040952 A * 2/2001
JP 2009235811 A * 10/2009

* cited by examiner

JALOUSIE WINDOW DEVICE

FIELD OF THE INVENTION

This invention relates to an improved device forming a jalousie.

BACKGROUND OF THE INVENTION

Whenever possible it is desirable to equip a building located in a hot, especially tropical, region with natural ventilation means providing satisfactory thermal comfort, without the need for expensive and energy-hungry air-conditioning means.

Thus, it has already been proposed in the state of the art to equip a building opening for window with a device forming a jalousie.

A device forming a jalousie generally includes several hinged louvres each pivoting about an axis. The various pivoting axes of the louvres are substantially parallel to each other.

The pivoting axis of each louvre consists of a pair of first and second trunnions, called support trunnions, locked in rotation with the louvre. At least one support trunnion is provided with means for coupling with means for driving in rotation this support trunnion that are operated, for example, by a lever handle.

To allow daylight to enter the building, the louvres of the device forming a jalousie are generally transparent or translucent.

The first and second support trunnions are journaled in respectively first and second support bearings formed in first and second uprights opposite each other forming a frame. The louvres can usually be operated by pivoting them by approximately 90 degrees between a closed position of the window and a maximum ventilation position allowing air to flow through the window.

A device forming a jalousie of the aforementioned type provides efficient natural ventilation while stopping the rain and allowing the window to be closed to avoid undesirable intrusion of animals or persons inside the building.

However, a device forming a jalousie of the aforementioned type has certain disadvantages.

Some regulations require that a window opening should be protected from sunlight to ensure better thermal regulation inside the building. In the state of the art, this is carried out by adding another item of equipment above the window opening, forming a canopy, protecting this window from the sun. One disadvantage with this type of equipment is that it creates a projection on the front of the building which is not always aesthetic.

Furthermore, since the louvres of a device forming a jalousie are generally transparent, they do not provide a shading function preventing light from entering through the window.

Document GB2252349A describes a device forming a jalousie comprising two pivoting louvres.

SUMMARY OF THE INVENTION

The invention aims to propose a device forming a jalousie capable of offering, using simple means integrated with this device, solar protection and shading functions.

The invention therefore relates to a device forming a jalousie, characterised in that it comprises at least first and second louvres pivoting about a common axis between a position in which the two louvres overlap and a position of angular separation of the louvres about the common axis, and in that the common axis consists of a first connecting trunnion and a first connecting bearing, integral with the first louvre, intended to cooperate respectively with a second connecting bearing and a second connecting trunnion integral with the second louvre.

Since the device forming a jalousie according to the invention is equipped with at least first and second louvres pivoting about a common axis, one of the two louvres can be opaque to provide both the solar protection and shading functions, without overly increasing the size of the device forming a jalousie.

In addition, the device forming a jalousie according to the invention is equipped with a first connecting trunnion, integral with the first louvre, cooperating with a second connecting bearing, integral with the second louvre and a first connecting bearing, integral with the first louvre, cooperating with a second connecting trunnion, integral with the second louvre. These first and second connecting trunnions and these first and second connecting bearings form hinging means which are dissymmetric, in the sense that at a first end of the louvres, the trunnion is carried by the first louvre and the bearing is carried by the second louvre, while at the second end of the louvres, the trunnion is carried by the second louvre while the bearing is carried by the first louvre.

Due to this dissymmetry, the louvres and hinges have a simplified shape and the means for pivoting the louvres together are of reduced size.

The invention may also comprise the following optional characteristics:

- the common axis consists of first and second trunnions called support trunnions locked in rotation respectively with the first and second louvres, each of the first and second support trunnions being integral with means for coupling with corresponding means for driving in rotation:
- the first support trunnion and the first connecting trunnion are formed on a first pin integral with a profile of the first louvre;
- the first pin is mounted in a tubular section of the profile, this first pin being immobilised in rotation in this tubular section by immobilisation means, for example keying means;
- the means for immobilising the first pin in the tubular section of the profile of the first louvre comprise an axial rib formed on the first pin, forming keying means, the second connecting bearing of the second louvre comprising a contour complementary to the first pin and its axial rib to allow the first pin to be assembled through the second connecting bearing;
- the first connecting bearing is delimited by a tubular section of the profile;
- the first louvre comprises a first plate mounted in a groove of the profile, for example by pinching effect;
- the second connecting bearing and the second connecting trunnion are carried respectively by two separate members forming brackets connected together by a second plate of the second louvre;
- the second support trunnion and the second connecting trunnion are formed on a second pin locked in rotation with one of the two members forming brackets;
- the members forming brackets carrying the second connecting bearing and the second connecting trunnion are connected to the second plate by screwing means capable of sliding, before tightening, in at least one rail for positioning the second plate;

the second louvre comprises at least one sealing element extending respectively one of the two opposite ends of the second plate, this sealing element being integral respectively with one of the members forming brackets carrying the second connecting bearing and the second connecting trunnion;

the first and second support trunnions are journaled respectively in first and second support bearings formed in two uprights opposite each other forming a support.

the first louvre is at least partly translucent and the second louvre is opaque.

BRIEF DESCRIPTION OF THE DRAWINGS

It will be easier to understand the invention on reading the description below, given as an example and referring to the attached drawings.

DETAILED DESCRIPTION OF THE INVENTION

Figure 1:
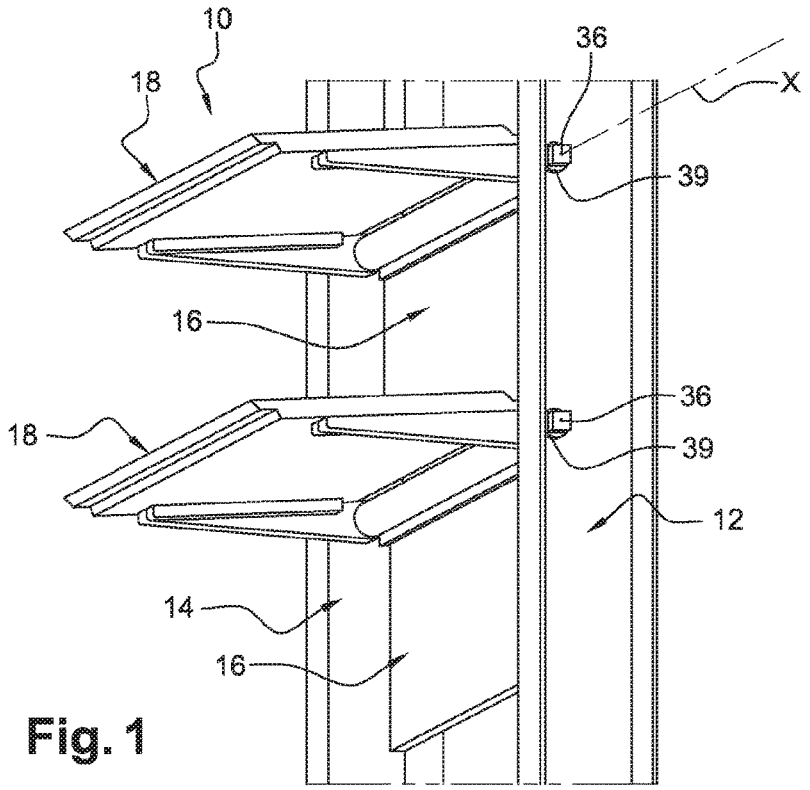
FIG. 1 is a perspective view of a device forming a jalousie according to the invention.

FIG. 1 shows a device forming a jalousie according to the invention, designated by the general reference 10.

This device 10 comprises first 12 and second 14 uprights opposite each other forming a support. The uprights 12, 14 form for example two opposite sides of a frame intended to be placed in a window opening. These uprights 12, 14 can be made of a traditional material, for example metal, in particular aluminium.

FIG. 1 shows two pairs of first 16 and second 18 louvres. The louvres 16, 18 of the same pair pivot about a common axis X between a position in which the two louvres 16, 18 overlap and a position of angular separation of the louvres 16, 18 about the common axis X. Preferably, the relative angular displacement about the axis X between the first 16 and second 18 louvres is between 0 and 90 degrees.

Obviously, the device forming a jalousie 10 may comprise more than two pairs of louvres 16, 18 or just one pair of louvres 16, 18.

Since the pairs of louvres 16, 18 are substantially identical, only one pair of louvres 16, 18 will be described in the remainder of the document.

Figure 2:
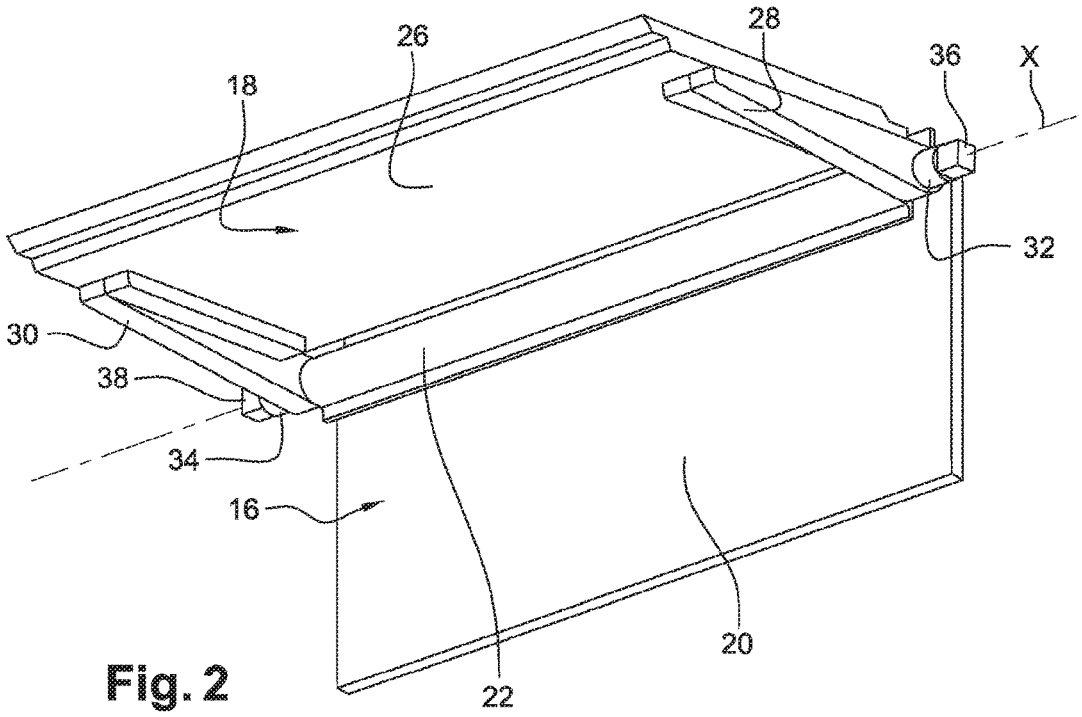
FIG. 2 is a perspective view of the first and second louvres pivoting about a common axis of the device forming a jalousie shown on FIG. 1.
Figure 3:
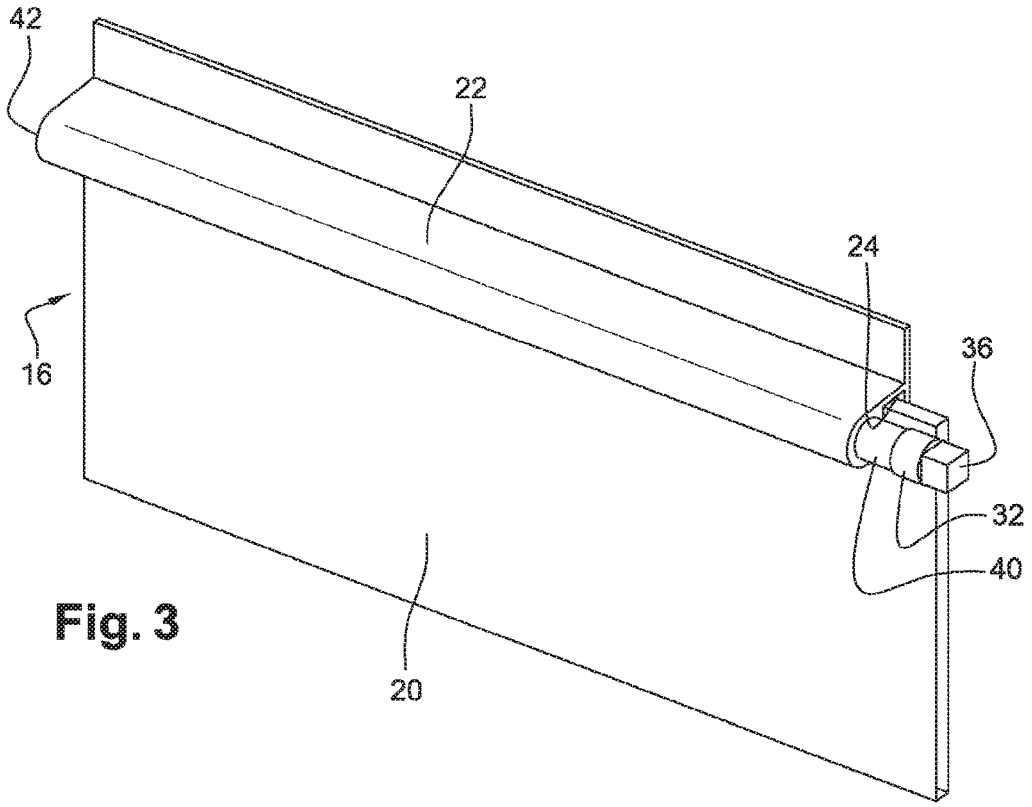
FIG. 3 is a perspective view of the first louvre shown on FIG. 2.
Figure 4:
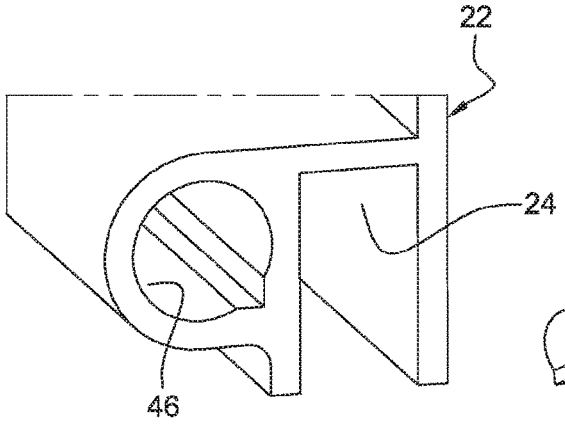
FIG. 4 is a perspective view of one end of a profile of the first louvre shown on FIG. 3.
Figure 5:
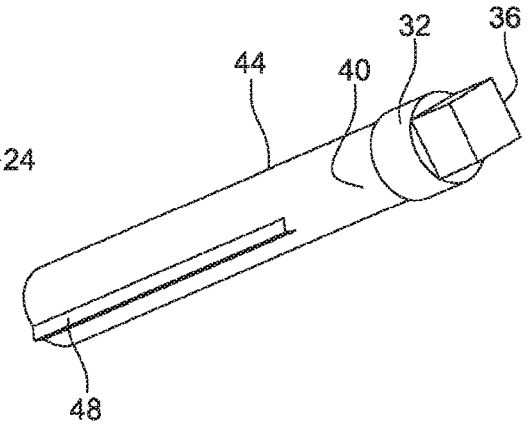
FIG. 5 is a perspective view of a first pin integral with the profile shown on FIG. 4.
Figure 6:
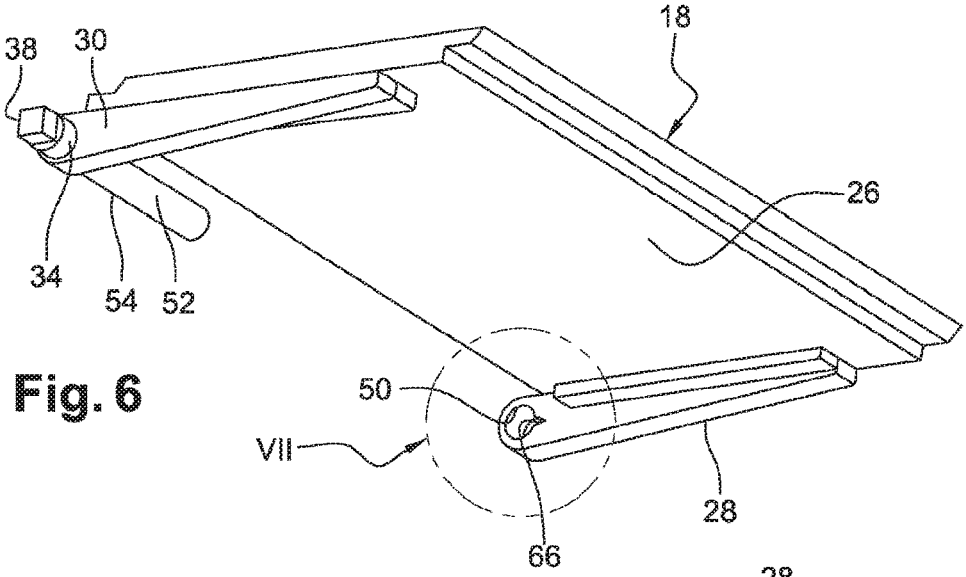
FIG. 6 is a perspective view of the second louvre shown on FIG. 2.
Figure 7:
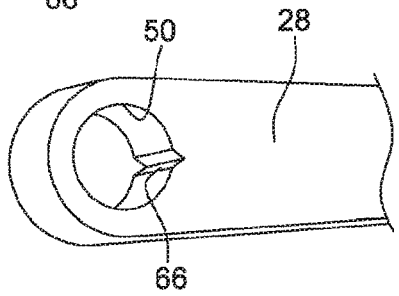
FIG. 7 is a detail view of the part circled VII on FIG. 6.
Figure 8:
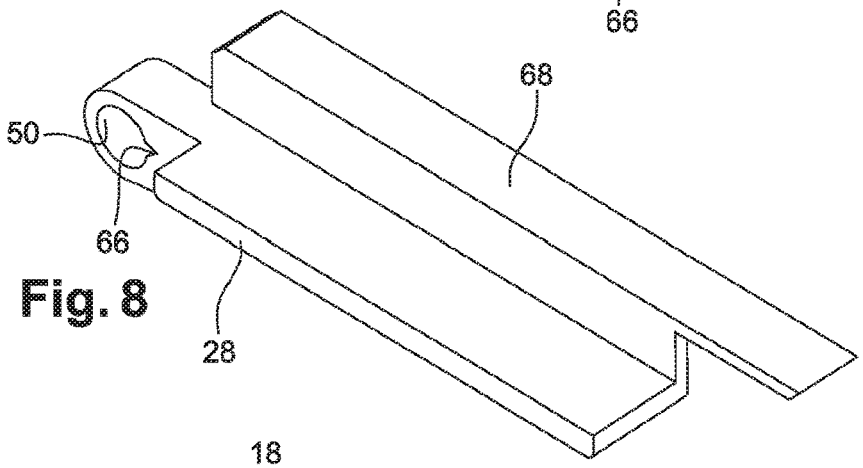
FIG. 8 is a perspective view of a member of the second louvre, this member forming a bracket and being equipped with a sealing element.

Referring to FIGS. 2, 3 and 6, we see that the first louvre 16 comprises a first transparent or translucent plate 20, for example made of glass, as well as a profile 22, for example made of metal. The first plate 20 is mounted in a groove 24 of the profile 22, visible in greater detail on FIG. 4, for example by pinching effect. If necessary, a traditional rubber seal is inserted between the first plate 20 and the groove 24 to avoid damaging this plate 20. This profile 22 is for example made of polymer or metal, for example aluminium.

The first louvre 16 is at least mostly transparent or translucent. The profile 22 is in fact opaque but the plate 20, which forms most of the first louvre 16, allows light to pass through this first louvre 16.

The second louvre 18 comprises a second opaque plate 26, for example made of wood, polymer or metal. The material and thickness of the second plate 26 are selected so that it is rigid enough when operating the second louvre 18, in particular to avoid undesirable torsion of this second plate 26. The second louvre 18 also comprises two separate members 28, 30 each forming a bracket, for example made of metal or polymer. These separate members forming brackets 28, 30 are connected together by the plate 26 of the second louvre 18. The second louvre 18 is therefore generally opaque.

Note that the first 20 and second 26 plates have a substantially rectangular general shape and dimensions adapted so that the second louvre 18 can cover, preferably at least mostly, the first louvre 16.

The common axis X consists of first 32 and second 34 trunnions, called support trunnions, locked in rotation respectively with the first 16 and second 18 louvres. Each of the first 32 and second 34 support trunnions is integral with means 36, 38 for coupling with corresponding means for driving in rotation and operating. The coupling means 36, 38 are preferably of the type based on cooperation of complementary shapes and comprise, for example, polygonal contours intended to cooperate with complementary contours of elements for driving in rotation.

Note that all of the first louvres 16 are operated using first traditional means for driving in rotation and operating (not shown) comprising for example a linkage, a lever handle and/or a hoist. Similarly, all the second louvres 18 are operated using second traditional means for driving and operating (not shown) comprising for example a linkage, a lever handle and/or a hoist.

The first 32 and second 34 support trunnions are journaled in respectively first and second support bearings formed in two uprights 12, 14 opposite each other forming a support. The figures only show the support bearing 39 formed in the upright 12.

Referring more particularly to FIGS. 3 to 8, we see that the common axis X also consists of a first connecting trunnion 40 and a first connecting bearing 42 integral with the first louvre 16.

In the example illustrated, the first support trunnion 32 and the first connecting trunnion 40 are formed on a first pin 44 locked in rotation with the profile 22. The first pin 44 is in fact mounted inserted in a tubular section 46 of the profile 22. The first pin 44 is immobilised in rotation in this tubular section 46 by immobilisation means comprising for example an axial rib 48 formed on the first pin 44. This rib 48 thus forms keying means.

The first pin 44 is for example made of metal, preferably aluminium, or polymer.

Note that the first connecting bearing 42 is delimited by one end of the tubular section 46 of the profile 22 opposite the end of this tubular section 46 into which the first pin 44 is inserted.

The first connecting trunnion 40 and the first connecting bearing 42 are intended to cooperate respectively with a second connecting bearing 50 and a second connecting trunnion 52 locked in rotation with the second louvre 18. The second connecting bearing 50 is carried by the first member 28 forming a bracket. The second connecting trunnion 52 is carried by the second member 30 forming a bracket.

Note that the second support trunnion 34, the coupling means 38 integral with this second support trunnion 34 and the second connecting trunnion 52 are formed on a second pin 54 locked in rotation with the second member 30 forming a bracket. This second pin 54 is attached to the second member 30 forming a support or produced in one piece with this second member 30 forming a support.

The members forming brackets 28, 30 therefore carry respectively the second connecting bearing 50 and the second connecting trunnion 52 forming the common axis.

If the second pin 54 is attached to the second member 30, it can be immobilised in rotation in an orifice of this second pin 54 by keying means such as those used for the first pin 44.

The second pin 54 is for example made of metal, preferably aluminium, or polymer.

Figure 9:
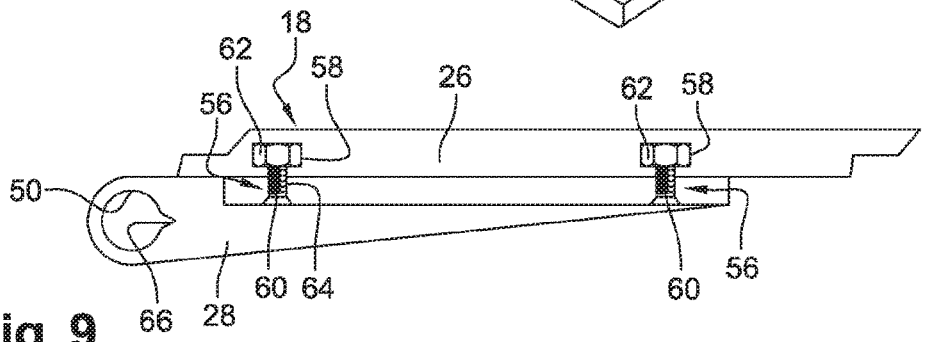
FIG. 9 is a side view of the second louvre showing screwing means connecting the member forming a bracket to a plate of the second louvre.

Referring to FIG. 9, note that each member forming a bracket 28, 30 is connected to the second plate 26 by screwing means 56 capable of sliding, before tightening, in a pair of rails 58, formed in the second plate 26. These rails 58 are used to position this second plate 26 with respect to the members forming brackets 28, 30. Note that the two rails 58 are substantially parallel and extend substantially parallel to the larger dimension of the second plate 26.

For each member forming a bracket 28, 30 and for each rail 58, the screwing means 56 comprise for example a screw 60 and a nut 62. The screw 60 is mounted in a through-seat 64 formed in the corresponding member forming a bracket 28, 30. The nut 62 is mounted slidably in the corresponding rail 58.

According to a variant, a single rail 58 cooperating with corresponding screwing means 56 carried by the members forming brackets 28, 30 could be provided.

According to another variant, each member forming a bracket 28, 30 could be connected to the second plate 26 by means other than the screwing means 56, i.e. traditional means providing a rigid connection between the second plate 26 and the members forming brackets 28, 30.

To assemble the two louvres 16, 18 together, it would be possible for example to proceed as follows.

The first louvre 16 is first mounted as shown on FIG. 3, i.e. with the first plate 20 inserted in the groove 24 of the profile and with the first pin 44 inserted in the tubular section 46 of the profile.

However, before inserting the first pin 44 in the tubular section 46 of the profile, the first member forming a bracket 28 is placed around this first pin 44, inserting the first connecting trunnion 40 in the second connecting bearing 50. Note that this second connecting bearing 50 comprises a contour 66 complementary to the contour of the first pin 44 and to its axial rib 48 so that the first pin 44 can be mounted through the second connecting bearing 50 (see FIG. 7).

The second member forming a bracket 30 is then placed around the second pin 54, inserting the second connecting trunnion 52 in the first connecting bearing 42 of the profile 22.

Lastly, the members forming a support 28, 30 are connected together using screwing means 56 and the second plate 26, the positions of the various elements being adjusted using the rails 58, before tightening the screwing means 56.

The device 10 comprises, if necessary, sealing means of the type traditionally fitted on a device forming a jalousie. Furthermore, in order to increase the raintightness of the device forming a jalousie 10, the second louvre 18 preferably comprises two sealing elements 68 extending respectively the two opposite ends of the second plate 26. These two sealing elements 68 are integral respectively with the two members forming brackets 28, 30 for example by being produced in one piece with these members 28, 30.

As a variant, the second louvre 18 could comprise only one sealing element 68 carried by one of the members forming brackets 28, 30.

Note that the second louvre 18, equipped in particular with the sealing elements 68, optimises the sealing of the device forming a jalousie 10, which is advantageous when such a device is installed in a region likely to be subject to heavy rainfall together with strong winds increasing the risk of water and humidity penetrating between the louvres even when they are closed.

The device forming a jalousie 10 described above can provide a range of functions by adjusting the relative angular positions of the louvres 16, 18. The main functions are described below, referring in particular to FIG. 1 and FIGS. 10 to 12.

FIG. 1 shows the device forming a jalousie 10 in a configuration in which protection is provided against sunlight and in which the ventilation is closed (by closing the passage of air through the device 10).

Each first louvre 16 is in fact in a first limiting position with the ventilation closed in which it is substantially parallel to the uprights 12, 14 and blocks the opening of the window thereby preventing air from flowing through this window.

However, each second louvre 18 is in a limiting position substantially perpendicular to the first louvre 16 protecting the window opening from sunlight.

Figure 10:
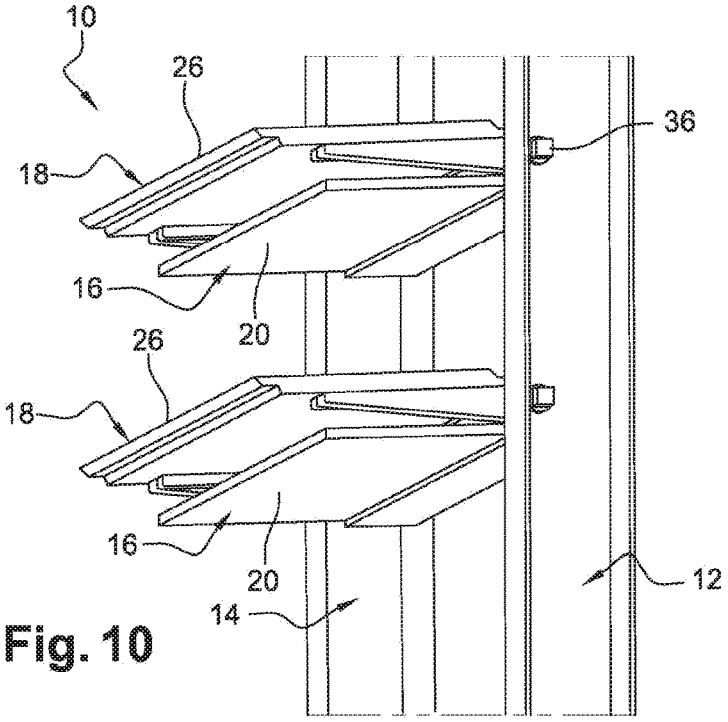
FIGS. 10 to 12 are views similar to FIG. 1 showing the device forming a jalousie in various use configurations.

FIG. 10 shows the device forming a jalousie 10 in a configuration in which the ventilation is opened, unlike the previous case.

In this case, the second louvres 18 are held in the position shown on FIG. 1, in which they protect the window from sunlight. However, the first louvres 16 are placed in a limiting position substantially parallel to that of the second louvres 18 allowing air to flow through the device forming a jalousie.

Figure 11:
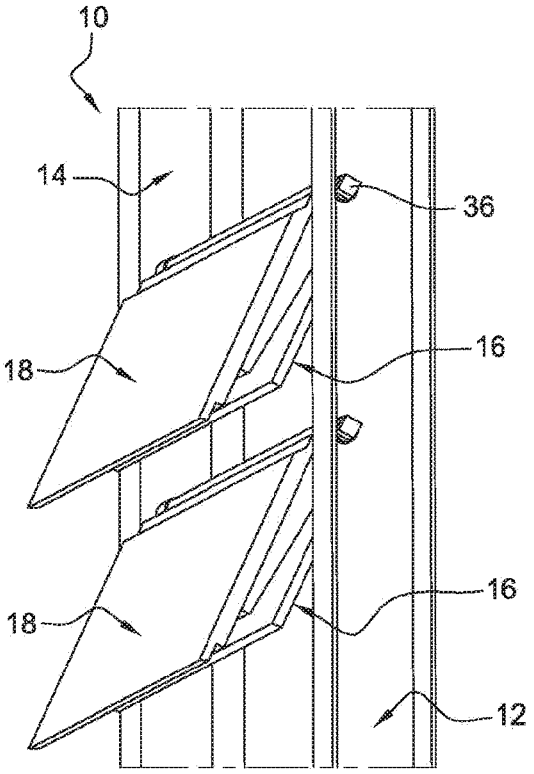

FIG. 11 shows the device forming a jalousie 10 in an intermediate configuration, allowing more limited ventilation than in the case shown on FIG. 10. In this case, the first louvres 16 are in an intermediate position between the two limiting positions shown on FIGS. 1 and 10. The second louvres 18 are in an angular position substantially identical to that of the first louvres 16 in which they provide partial shading from the sunlight.

Figure 12:
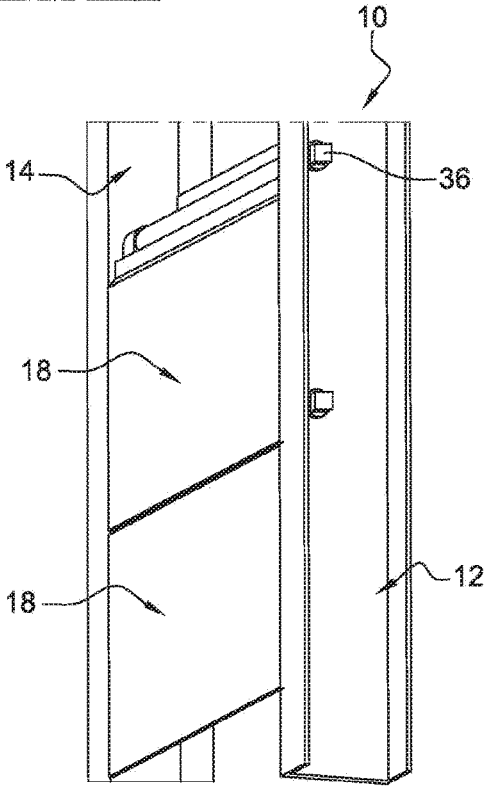

FIG. 12 shows the device forming a jalousie 10 in a configuration in which it provides maximum shading and in which the ventilation is closed.

The first louvres 16 are in the position shown on FIG. 1 with the ventilation closed and the second louvres 18 are substantially in the same angular position as that of the first louvres 16, in which they provide a maximum shading function. Thus, in the case of FIG. 12, all the louvres, i.e. the first 16 and second 18 louvres are in a position substantially parallel to the uprights 12, 14.

The invention is not limited to the embodiment described and other embodiments will be clearly apparent to those skilled in the art.

In particular, note that the device forming a jalousie 10 may comprise rubber stops, inserted between the first and second louvres when they are in substantially identical angular positions, to avoid direct contact between rigid elements of the first and second louvres.

The invention claimed is:

1. A device for forming a jalousie comprising:

at least first and second louvres pivoting about a common axis between a position in which the two louvres overlap and a position of angular separation of the louvres about the common axis;

said common axis comprising a first connecting trunnion and a first connecting bearing, integral with the first louvre, which cooperates respectively with a second connecting bearing and a second connecting trunnion integral with the second louvre;

said common axis further comprising first and second support trunnions locked in rotation respectively with the first and second louvres, each of the first and second support trunnions being integral with means for coupling with corresponding means for driving in rotation.

2. The device according to claim 1, wherein the first support trunnion and the first connecting trunnion are formed on a first pin integral with a profile of the first louvre.

3. The device according to claim 2, wherein the first pin is mounted in a tubular section of the profile, said first pin being immobilised in rotation in said tubular section by immobilisation means.

4. The device according to claim 3, wherein the immobilisation means comprise:

an axial rib formed on the first pin, forming keying means; and the second connecting bearing of the second louvre comprising a contour complementary to the first pin and said axial rib to allow the first pin to be assembled through the second connecting bearing.

5. The device according to claim 4, wherein the first connecting bearing is delimited by the tubular section of the profile.

6. The device according to claim 4, wherein the first louvre comprises a first plate mounted in a groove of the profile, for example by pinching effect.

7. The device according to claim 3, wherein the first connecting bearing is delimited by the tubular section of the profile.

8. The device according to claim 7, wherein the first louvre comprises a first plate mounted in a groove of the profile, for example by pinching effect.

9. The device according to claim 3, wherein the first louvre comprises a first plate mounted in a groove of the profile, for example by pinching effect.

10. The device according to claim 2, wherein the first louvre comprises a first plate mounted in a groove of the profile.

11. The device according to claim 1, wherein the second connecting bearing and the second connecting trunnion are carried respectively by two separate members forming brackets connected together by a second plate of the second louvre.

12. The device according to claim 11, wherein the second support trunnion and the second connecting trunnion are formed on a second pin locked in rotation with one of the members forming brackets.

13. The device according to claim 12, wherein the members forming brackets are connected to the second plate by screwing means capable of sliding, before tightening, in at least one rail for positioning the second plate.

14. The device according to claim 12, wherein the second louvre comprises at least one sealing element extending along one end of the second plate, said sealing element being integral respectively with one of the members forming brackets.

15. The device according to claim 11, wherein the members forming brackets are connected to the second plate by screwing means capable of sliding, before tightening, in at least one rail for positioning the second plate.

16. The device according to claim 15, wherein the second louvre comprises at least one sealing element extending along one end of the second plate, said sealing element being integral respectively with one of the members forming brackets.

17. The device according to claim 11, wherein the second louvre comprises at least one sealing element extending along one end of the second plate, said sealing element being integral respectively with one of the members forming brackets.

18. The device according to claim 1, wherein the first and second support trunnions are journaled in respectively first and second support bearings formed in two uprights opposite each other forming a support.

19. The device according to claim 1, wherein the first louvre is at least partly translucent and the second louvre is opaque.

* * * * *